US007607768B2

(12) United States Patent
Miller

(10) Patent No.: US 7,607,768 B2
(45) Date of Patent: Oct. 27, 2009

(54) LIQUID SUPPLY MEANS

(75) Inventor: Steven N Miller, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 417 days.

(21) Appl. No.: 11/386,166

(22) Filed: Mar. 21, 2006

(65) Prior Publication Data

US 2007/0222827 A1 Sep. 27, 2007

(51) Int. Cl.
*B41J 2/17* (2006.01)
*B41J 2/175* (2006.01)

(52) U.S. Cl. ..... 347/85; 347/84; 347/86

(58) Field of Classification Search ..... 347/85, 347/86, 84
See application file for complete search history.

(56) References Cited

U.S. PATENT DOCUMENTS 5,889,543 A * 3/1999 Miyazawa et al. ..... 347/86
6,027,205 A * 2/2000 Herbert ..... 347/54
6,067,906 A * 5/2000 Ryan et al. ..... 101/335
6,145,967 A 11/2000 Langford et al.
6,158,851 A * 12/2000 Zepeda ..... 347/85
6,186,620 B1 * 2/2001 Hsieh et al. ..... 347/84
6,390,613 B1 * 5/2002 Liu ..... 347/85
6,652,080 B2 11/2003 Childs et al.
6,702,434 B2 3/2004 Barinaga et al.
6,739,706 B2 5/2004 Barinaga et al.
6,752,493 B2 6/2004 Dowell et al.
6,769,763 B2 * 8/2004 Kurata et al. ..... 347/85
6,769,764 B2 8/2004 Barinaga et al.
6,799,842 B2 10/2004 Barinaga et al.
6,840,603 B2 1/2005 Barinaga et al.
6,899,028 B2 * 5/2005 Arai et al. ..... 101/335
6,905,198 B2 6/2005 Studer et al.
7,086,723 B2 * 8/2006 Hara et al. ..... 347/86
2002/0020601 A1 * 2/2002 Martin et al. ..... 192/85 AA
2002/0071013 A1 * 6/2002 Hsu et al. ..... 347/86
2003/0007040 A1 * 1/2003 Love et al. ..... 347/85
2003/0110967 A1 * 6/2003 McAnally et al. ..... 101/366

* cited by examiner

*Primary Examiner*—Stephen D Meier
*Assistant Examiner*—Sarah Al-Hashimi

(57) ABSTRACT

In accordance with one embodiment, a method of establishing fluidic communication between a liquid supply and a vessel includes drawing a given volume of fluid from the vessel into a chamber, and establishing fluidic communication between the liquid supply and the vessel after drawing the given volume of fluid.

18 Claims, 5 Drawing Sheets

LIQUID SUPPLY MEANS

BACKGROUND

Various devices use a supply of liquid to perform a given process. For example, each of a number of known types of inkjet printer devices depends upon a supply of liquid ink to perform a printing process. Devices that depend upon a supply of liquid can incorporate various ducts and reservoirs and the like for storing and/or moving liquid. It is generally known by those of ordinary skill in the art that gas can accumulate within liquid-filled spaces, such as vessels, ducts and/or reservoirs. Accumulation of gas within the ducts and/or reservoirs of a given device can, at least in some instances, adversely affect the performance of the device.

For example, at least one type of inkjet printer device can include a standpipe in the form of a tube or duct that extends upwardly from a print head orifice plate, or die. The standpipe can function to contain a supply of liquid ink that is made immediately available to the print head die. It is known that gas, which can be in the form of small bubbles, can accumulate within the standpipe of an inkjet print head. It is also known that a given amount of gas accumulation within the standpipe of an inkjet print head can have detrimental affects on the performance of the print head.

DETAILED DESCRIPTION

Figure 1:
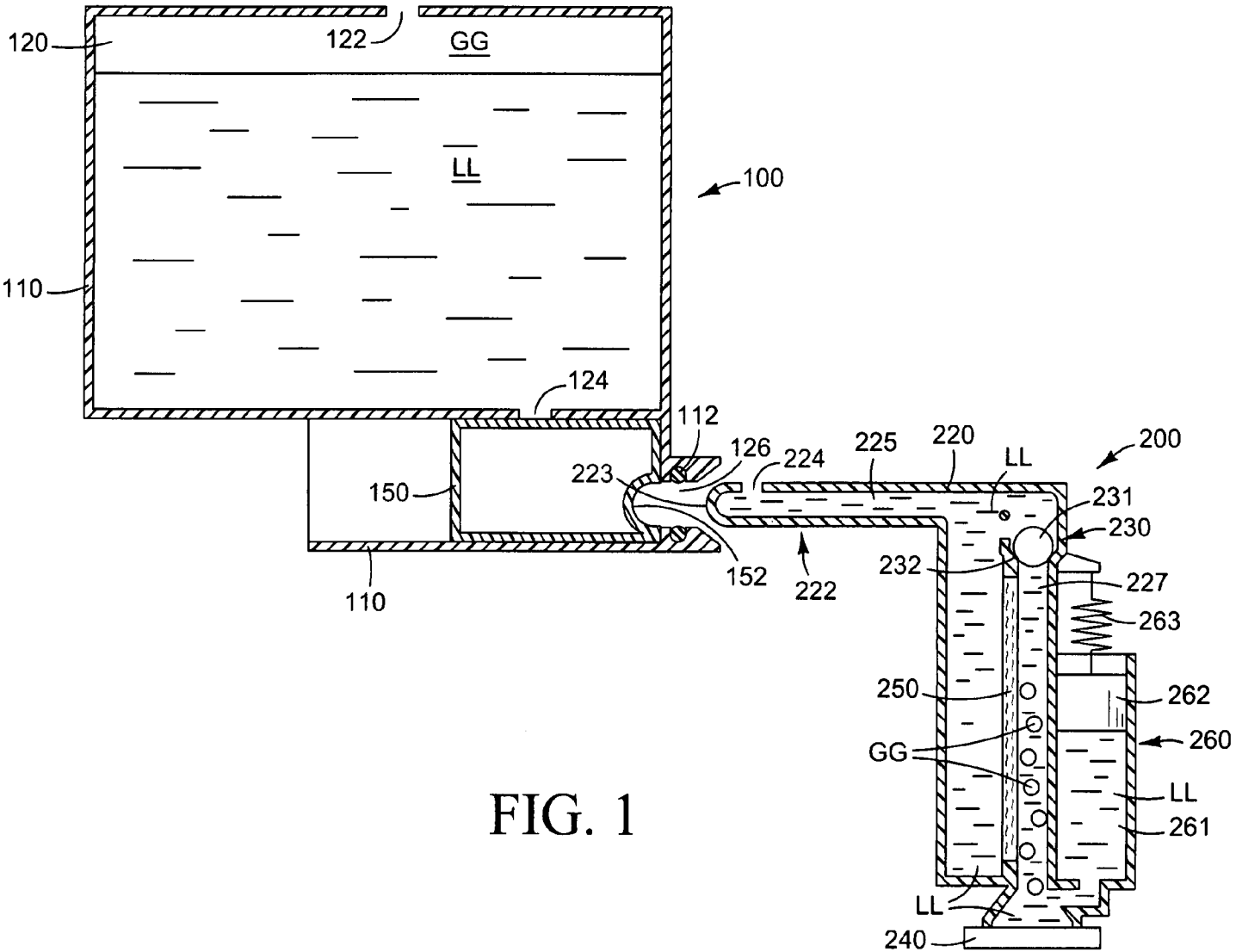
FIG. 1 is a side elevation view in which is depicted an apparatus in accordance with one embodiment.

With reference to the drawings, FIGS. 1 through 5 together make up a sequence of side elevation views in which is depicted an apparatus in accordance with one embodiment. With reference now to FIG. 1, a side elevation view depicts a liquid supply apparatus 100 in accordance with one embodiment. The apparatus 100 can include, and/or can be configured to be used in conjunction with, a vessel 200. In accordance with at least one embodiment, the apparatus 100 can be substantially in the form of an ink cartridge, while the vessel 200 can be substantially in the form of an inkjet print head to be used with the ink cartridge.

The apparatus 100 can include a wall 110. The wall 110 can be fabricated from any of a number of types of material including, but not limited to, plastic, metal, ceramic, and the like in accordance with various alternative embodiments. Furthermore, in accordance with each of a number of various alternative embodiments, the wall 110 can be rigid, semi-rigid, or flexible.

The wall 110 can enclose a reservoir 120. The reservoir 120 can be configured to contain a quantity of liquid LL, such as ink or the like. The wall 110 can define a vent opening 122 that can be near the top of the reservoir 120. The vent opening 122 can be configured to provide gaseous communication, and/or pressure equalization, between the reservoir 122 and surrounding ambient atmosphere. Accordingly, the reservoir 122 can contain, above the liquid LL, an amount of gas GG, such as air.

It is understood that the vent opening 122 can include a vent plug (not shown) configured to allow passage of gas while preventing passage of liquid, and of which various types are known to those of ordinary skill in the art. It is also understood that, inasmuch as the apparatus 100 and the vessel 200 can be configured substantially in the forms of an inkjet cartridge and an inkjet print head, respectively, the apparatus 100 can include any of a number of means for providing "back pressure" as known to those of ordinary skill in the art. Such means can include, but are not limited to, an entrained ink chamber, a spring-loaded bag, a bladder, and a diaphragm.

The wall 110 can define an aperture 124. The apparatus 100 can include an element 150. The element 150, or at least a portion thereof, can be movable relative to the wall 110. The element 150 can be configured to block and/or unblock the aperture 124 by way of movement of the element relative to the aperture. That is, the element 150 can be configured to block or unblock the aperture 124 depending upon the position of the element relative to the aperture.

In this manner, the aperture 124 and the element 150 together can be configured to selectively enable liquid LL to drain from the reservoir 120. The wall 110 can define a portal 126. The apparatus 100 can include a seal 112 such as, but not limited to, an o-ring or a septum, wherein the seal can be proximate the portal. The element 150 can define an engagement feature 152, which is described in greater detail below.

As is mentioned above, the apparatus 100 can be configured to be used in conjunction with a vessel such as the vessel 200. The vessel 200 can be configured to contain a quantity of liquid LL. The liquid LL contained in the vessel 200 can be the same liquid as is contained in the liquid supply apparatus 100. The vessel 200 can be configured to perform any of a number of possible processes that require liquid LL within the vessel to be replenished. As is described in greater detail below, the apparatus 100 can be employed to supply liquid LL to the vessel 200.

The vessel 200 can include a wall 220 that can define a standpipe area 227. The wall 220 can be fabricated from any of a number of types of material including, but not limited to, plastic, metal, ceramic, and the like in accordance with various alternative embodiments. Furthermore, in accordance with each of a number of various alternative embodiments, the wall 220, or at least a portion thereof, can be rigid, semi-rigid, or flexible.

The apparatus 100 can include a probe 222. The probe 222 can be separate from, and/or not connected to, the apparatus 100. The probe 222 can be fluidically communicable with the vessel 200. In accordance with one embodiment, the probe 222 can be defined by the wall 220 of the vessel, wherein the duct is a substantial extension of the vessel and/or wherein the probe forms a portion of the vessel.

The probe 222 can be substantially elongated, and can extend from the standpipe area 227 as depicted. A distal end 223 can be defined on the probe 222. The probe 222 can have a substantially constant width or cross sectional area along its length. In accordance with at least one embodiment, the probe 22 can be substantially cylindrical with a substantially circular cross sectional shape.

The probe 222 can define therein a duct 225 that can be fluidly communicable with the standpipe area 227. The probe 222 can also define an orifice 224 that can be in the form of a hole, or opening, in the wall 220. The orifice 224 can be substantially proximate the end 223 of the probe 222. The orifice 224 can enable fluid to enter and/or exit the probe 222.

The vessel 230 can include a check valve 230. The check valve 230 can be, for example, in the form of a ball-and-seat check valve as depicted. The vessel 230 can include, for example, a ball 231 that is configured to substantially seal against a corresponding seat 232. The check valve 230 can be configured to allow fluid to flow past the check valve and out of the standpipe area 227, while preventing fluid from flowing past the check valve and into the standpipe area. It is understood that the check valve 230 can have any of a number possible forms other than that specifically shown and/or described herein.

The vessel 200 can include a filter 250. The vessel 200 can include a print head die, or orifice plate, 240. The configuration and operation of print head dies, such as the print head die 240, are known to those of ordinary skill in the art. Gas GG can accumulate within the vessel 200. Gas GG can accumulate, for example, within the standpipe area 227 of the vessel 200. The gas GG can be substantially in the form of bubbles as is depicted.

The vessel 200 can include a compensator 260. The compensator 260 can be configured to change the effective volume of the vessel 200, as is described in greater detail below. In accordance with one embodiment, the compensator 260 can be substantially in the form of, and/or can include, a cylinder 261 and a piston 262 slidably and sealingly disposed within the cylinder. The compensator 260 can include an actuation element 263, which can be in the form of a spring, or an actuator or the like, and which can be connected to the piston 262. It is understood that the compensator 260 can have any of a number of alternative forms not specifically shown or described herein. For example, in accordance with at least one embodiment not shown or described herein, the compensator 260 can be substantially in the form of a diaphragm.

The apparatus 100 and the vessel 200 can be configured to be engaged with one another so that movement of the apparatus 100 against the vessel 200 can cause movement of the element 150 relative to the wall 110 of the apparatus. More specifically, in accordance with one embodiment, movement of the apparatus 100 relative to the vessel 200 can result in impingement of the vessel against the element 150 to result in movement of the element relative to the wall 110 of the apparatus.

In accordance with at least one embodiment, the probe 222 can be configured to be inserted through the portal 126 and to engage and/or impinge upon the element 150, and to move the element relative to the wall 110. The seal 112 can be configured to sealingly engage the probe 222 as the probe is inserted through the portal 126. That is, the seal 112 can be configured to seal against the probe 222 while also allowing the probe to slide through the seal. Moreover, the end 223 of the probe 222 can engage the feature 152 of the element 150 as the probe impinges upon the element. For example, the feature 152 can be an indentation formed in the element 150, into which indentation the end 223 of the probe 222 can snugly fit.

Figure 2:
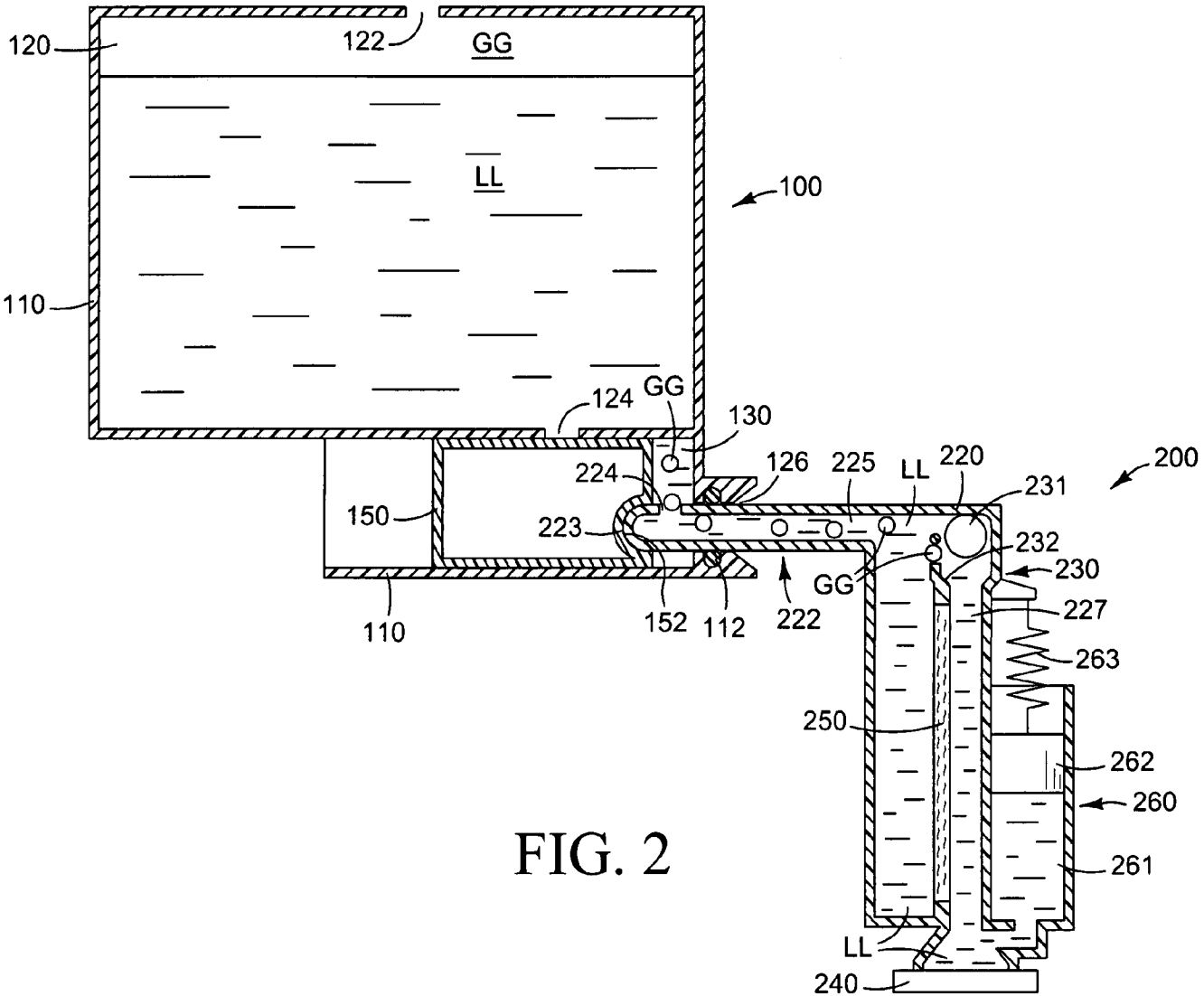
FIG. 2 is another side elevation view in which the apparatus is depicted.

Turning now to FIG. 2, impingement of the probe 222 against the element 150 can cause the element to move relative to the wall 110 of the apparatus 100. A chamber 130 can be formed by the element 150 and the wall 110 of the apparatus 100. The chamber 130 can be expandable by way of movement of the element 150 relative to the wall 110. That is, movement of the element 150 relative to the wall 110 can cause the volume of the chamber 130 to expand.

In accordance with one embodiment, the chamber 130 can be substantially in the form of a cylinder having a piston slidably disposed therein. For example, in accordance with one embodiment, the element 150 can be substantially in the form of a piston that is slidably and sealingly disposed within a cylinder formed by at least a portion of the wall 110, as depicted. It is understood that in accordance with each of a number of embodiments, the element 150 can be a piston having any of a number of possible cross sectional shapes such as, but not limited to, circular, square, triangular, oval, elliptical, hexagonal, and the like.

Expansion of the chamber 130 with the seal 112 being sealingly engaged with the probe 222, and with the orifice 224 being located within the chamber, can result in fluid being drawn into the chamber from the vessel 200, wherein the fluid can include liquid LL and/or gas GG. That is, the chamber 130 can be configured to limit fluidic communication of the orifice 224 to only the chamber until the chamber has expanded beyond a given volume.

As the chamber 130 expands, the compensator 260 can contract. That is, as liquid LL and/or gas GG is drawn into the chamber 130 from the vessel 200, the volume of liquid and gas within the vessel can decrease, which in turn, can cause the compensator 260 to contract. More specifically, in accordance with at least one embodiment, movement of liquid LL and/or gas GG from the vessel 200 and into the chamber 130 by expansion of the chamber, can cause the piston 262 to move within the cylinder 261 so that liquid LL within the cylinder is moved into the standpipe area 227.

Movement of liquid LL from the cylinder 261 into the standpipe area 227 can cause the liquid and/or gas GG within the standpipe area to move out of the standpipe area and past the check valve 230 and into the duct 225. From the duct 225, liquid LL and/or gas GG can flow out of the duct through the orifice 224, and into the chamber 130.

Figure 3:
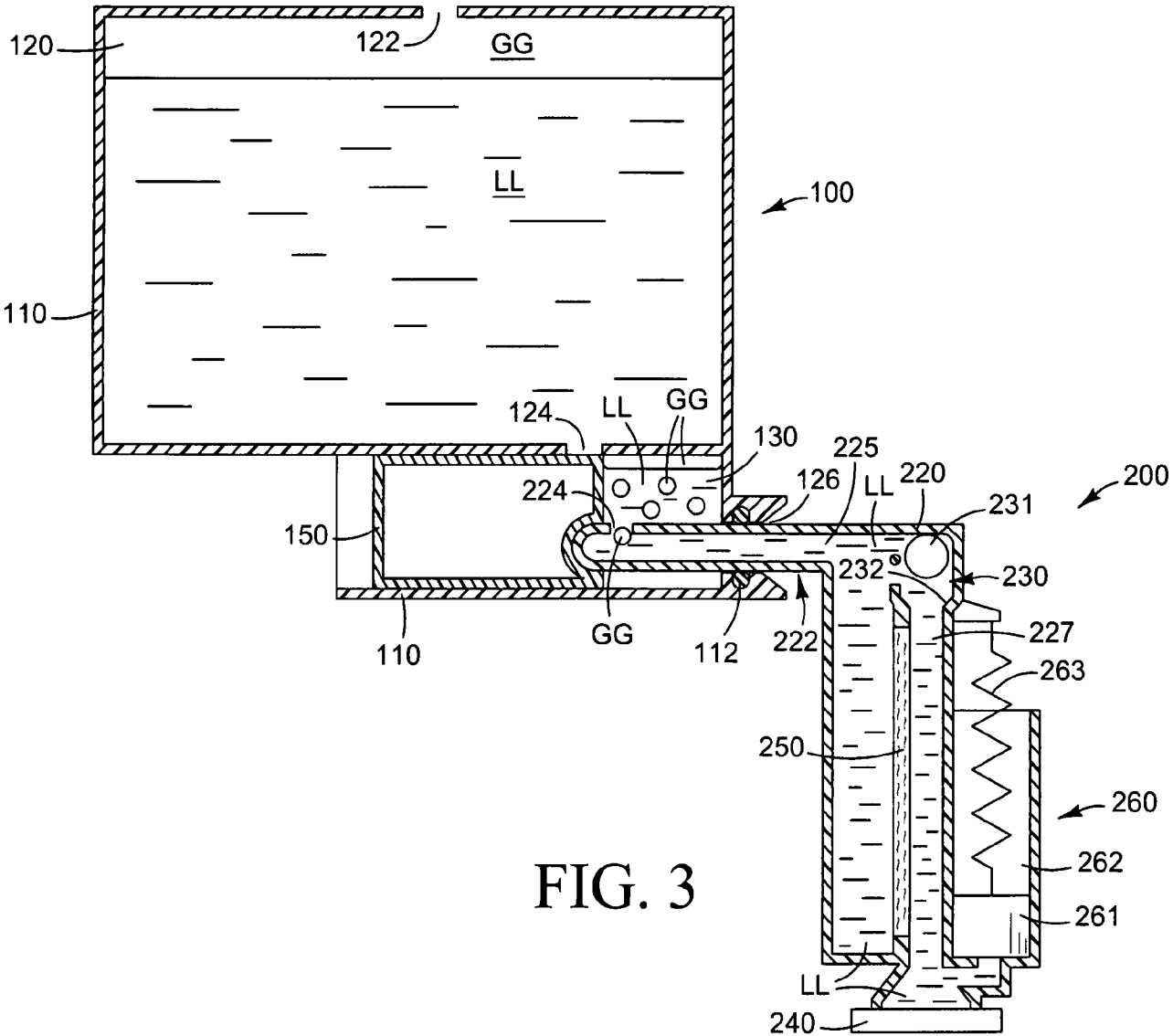
FIG. 3 is another side elevation view in which the apparatus is depicted.

With reference now to FIG. 3, it is seen that continued expansion of the chamber 130 can cause a given volume of fluid to be drawn into the chamber, wherein the fluid can include liquid LL and/or gas GG. That is, the chamber 130 can expand to a given volume, beyond which given volume the aperture 124 will begin to open, or will begin to be unblocked by the element 150. The gas GG can rise to the top of the chamber 130, while the liquid LL can remain below the gas.

In accordance with at least one embodiment, the aperture 124 can be blocked by the element 150 when the volume of the chamber 130 is less than the given volume, and can be unblocked when the volume of the chamber 130 is greater than the given volume. In other words, the aperture 124 can be closed, or blocked, by the element 150 before a given amount of movement of the element, and the aperture can be opened, or unblocked, by the element after the given amount of movement of the element.

Figure 4:
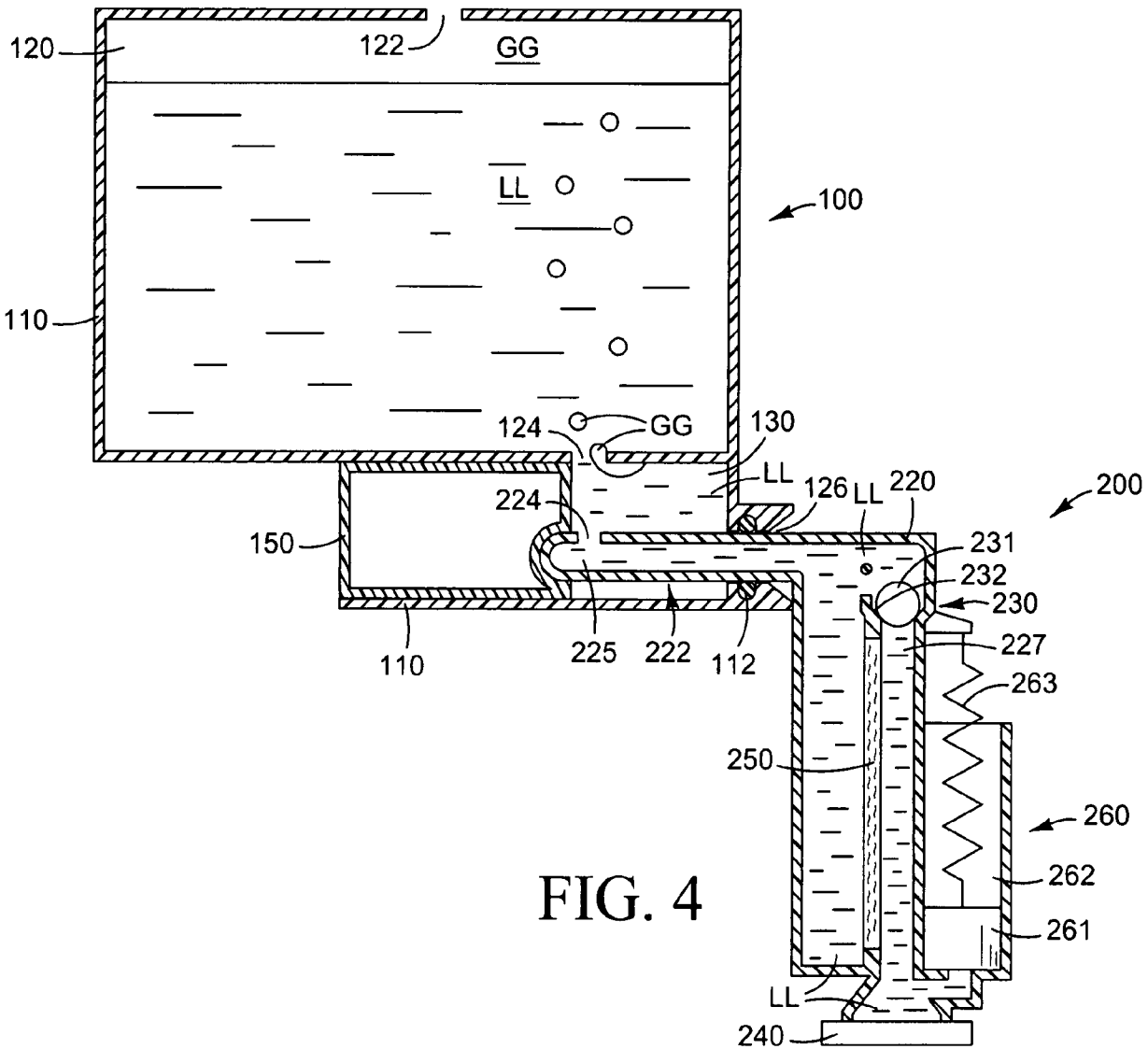
FIG. 4 is another side elevation view in which the apparatus is depicted.

Moving now to FIG. 4, it is seen that continued expansion of the chamber 130 beyond the given chamber volume, or beyond the given amount of movement of the element 150, can cause the aperture 124 to be opened, or unblocked. It is also seen that the opening, or unblocking, of the aperture 124 can enable fluid, including liquid LL and/or gas GG, to flow between the chamber 130 and the reservoir 120. For example, gas GG can flow from the chamber 130 into the reservoir 120 via the aperture 124, while liquid LL can flow from the reservoir into the chamber via the aperture.

It is seen yet further that the chamber 130 can be configured to establish fluidic communication between the reservoir 120 and the chamber 130 only after expansion of the chamber beyond the given volume. That is, in accordance with one embodiment, flow of liquid LL and/or gas GG between the reservoir 120 and the vessel 200 is prevented under a given chamber volume, and is enabled above the given chamber volume.

Figure 5:
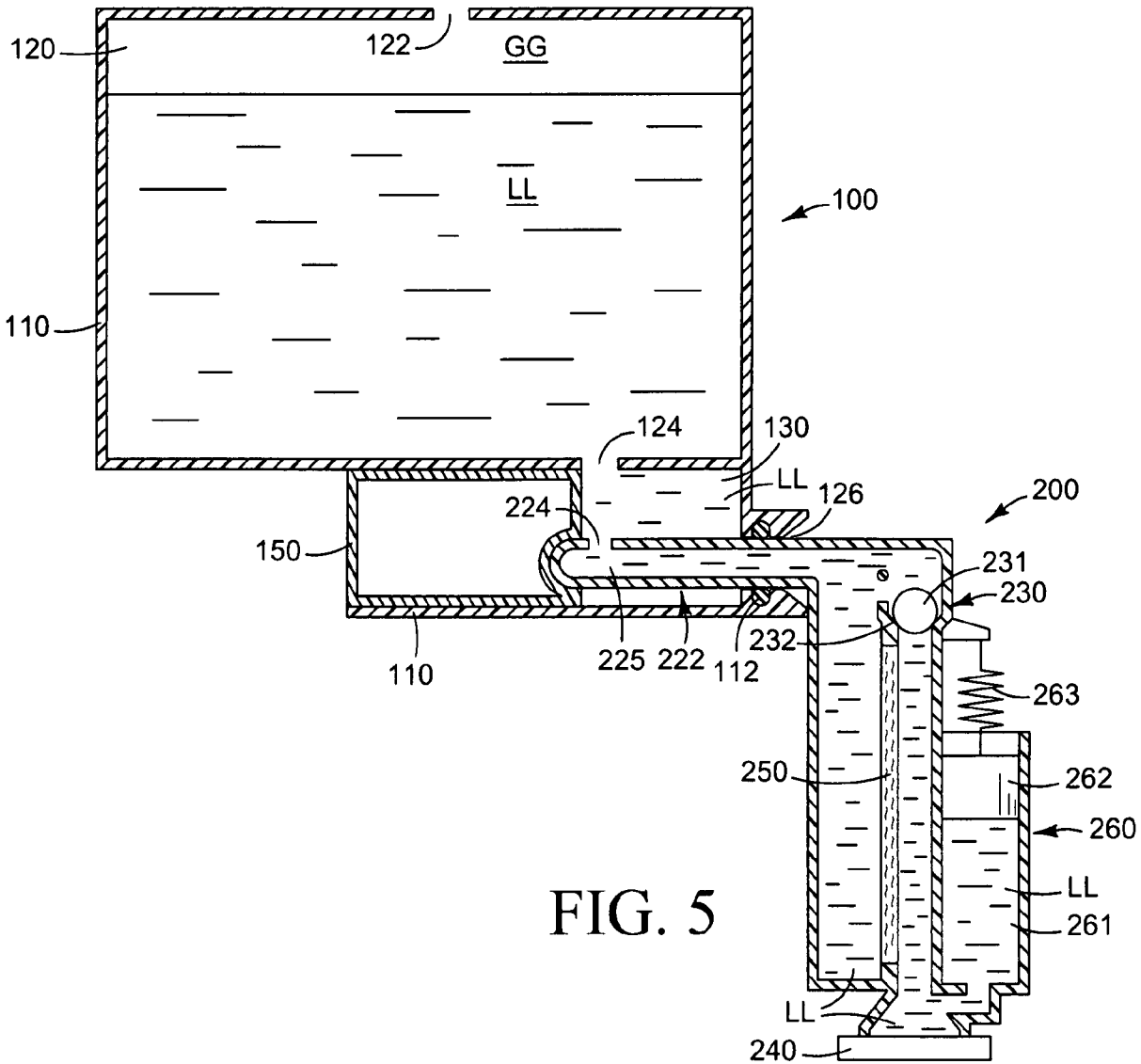
FIG. 5 is another side elevation view in which the apparatus is depicted.

With reference now to FIG. 5, it is seen that the apparatus 100 and/or the vessel 200 can be configured such that further expansion of the chamber 130 is limited after the aperture 124 has been opened or unblocked. Moreover, it is seen that after the aperture 124 has been opened or unblocked, the compensator 260 can be made to expand and thus refill with liquid LL.

This can be accomplished, in accordance with one embodiment, by way of the actuation element 263, which can be configured to cause the piston 262 to move relative to the cylinder 261 so as to draw liquid into the cylinder. For example, the actuation element 263 can move the piston 262 back to its original starting position before engagement of the vessel 200 and apparatus 100.

Once the chamber 130 has expanded beyond the given volume and the aperture 124 has been opened, or unblocked, liquid LL can flow from the reservoir 120 through the aperture and through the orifice 224 and into the vessel 200. In this manner, the vessel 200 can be supplied with liquid from the apparatus 100. For example, in accordance with one embodiment, the vessel 200 can be substantially in the form of an inkjet print head that is configured to eject liquid ink from the print head die 240.

Ejection of ink out of the vessel 200 by way of the print head die 240 can cause liquid ink to be drawn into the print head die from the standpipe area 227. The check valve 230 can remain closed, which can cause liquid ink to be drawn into the standpipe area 227 through the filter 250. As liquid ink is drawn through the filter 250, more liquid ink can enter the vessel 200 through the orifice 224. Likewise, additional liquid ink can be drawn through the orifice from the chamber 130 and/or the reservoir 120.

The apparatus 100, in accordance with one embodiment, can be used according to the following description by way of example only. With reference to FIG. 1, the reservoir 120 of the apparatus 100 can contain a quantity of liquid LL. The element 150 can be in a "pre expanded" position, wherein the element is proximate the portal 126, and wherein the element is blocking the aperture 124 as depicted.

With reference to FIG. 2, the probe 222 can be inserted through the portal 126, and the end 223 of the probe can engage the feature 152, which is defined on the element 150. The apparatus 100 and/or the vessel 200 can be moved relative to one another such that the probe 222 impinges upon the element 150 so as to cause the element to move relative to the wall 110 of the apparatus 100. Inasmuch as the seal 112 can sealingly engage the probe 222, a relative low pressure can be created within the chamber 130 as the chamber expands.

The relative low pressure within the chamber 130 as the chamber expands can cause fluid, including liquid LL and/or gas GG, to be drawn into the chamber from the vessel 200 through the orifice 224. Movement of liquid LL and/or gas GG out of the vessel 200 can cause the volume of the vessel to contract by way of contraction of the compensator 260. The compensator 260 can allow contraction of the volume of the vessel 200 by allowing the piston 262 to be drawn down within the cylinder 261 so as to cause the cylinder volume to decrease.

Movement of fluid from the vessel 200 and into the chamber 130 can result in opening of the check valve 230, whereupon liquid LL and/or gas GG can move out of the standpipe area 227 and past the check valve. In this manner, liquid LL and/or gas GG can move through the standpipe area 227 and then through the duct 225 and then through the orifice 224 and then into the chamber 130.

With reference to FIG. 3, further impingement of the probe 222 against the element 150 can cause expansion of the chamber 130 to a given volume, beyond which given volume further expansion of the chamber will result in opening of the aperture 124. When the chamber 130 has expanded to the given volume, a given quantity of liquid LL and/or gas GG has accumulated within the chamber.

With reference to FIG. 4, further impingement of the probe 222 against the element 150 can cause expansion of the chamber 130 beyond the given volume, whereupon the aperture 124 opens. Opening of the aperture 124 can allow gas GG to flow from the chamber 130 and/or from the vessel 200 into the reservoir 120 of the apparatus 100. Additionally, opening of the aperture 124 can allow liquid LL to flow from the reservoir 120 into the chamber 130 and/or from the reservoir 120 into the vessel 200.

With reference to FIG. 5, a given degree of expansion of the chamber 130 can result in establishment of fluidic communication between the reservoir 120 and the vessel 200. That is, upon a given degree of expansion of the chamber 130, liquid LL and/or gas GG can flow from the reservoir 120 into the vessel 200, and vice versa. For example, once fluidic communication is established between the reservoir 120 and the vessel 200, liquid LL can flow from the reservoir and through the orifice 224 and into the vessel, and then through the filter 250 and into the standpipe area 227.

From the standpipe area 227, liquid LL can flow to the print head die 240. Also, once fluidic communication is established between the reservoir 120 and the vessel 200, the compensator 260 can be enabled to expand the volume of the vessel back to its original level as described above so that the above described process can be repeated when necessary. In the manner described herein, the apparatus 100 can be used in conjunction with a vessel, such as the vessel 200, to supply liquid LL to the vessel while also removing a substantial portion of gas GG from the vessel.

In accordance with one embodiment, a method of establishing fluidic communication between a liquid supply, such as the liquid supply apparatus 100, and a vessel, such as the vessel 200, can include drawing a given volume of fluid from the vessel into a chamber, such as the chamber 130. The method also includes establishing fluidic communication between the liquid supply and the vessel after drawing the given volume of fluid. Establishment of fluidic communication between the liquid supply and the vessel can be accomplished, for example, by the means described herein above.

The method can further include expanding the chamber to draw the given volume of fluid into the chamber. The method can also include impinging at least a portion of the vessel against at least a portion of the chamber to cause the chamber to expand. Moreover, the method can include inserting at least a portion of the vessel inside the chamber, such as while impinging at least a portion of the vessel against at least a portion of the chamber.

The method can yet further include contracting at least a portion of the vessel in response to drawing the given volume of fluid into the chamber. Such contracting of at least a portion of the vessel can be accomplished, for example, by way of a compensator or the like, such as the compensator 260 described herein above. The method can also include defining the chamber substantially between a cylinder and a piston slidably disposed within the cylinder, wherein expanding the chamber is caused by sliding the piston within the cylinder.

The preceding description has been presented only to illustrate and describe exemplary methods and apparatus of the present invention. It is not intended to be exhaustive or to limit the disclosure to any precise form disclosed. Many modifications and variations are possible in light of the above teaching. It is intended that the scope of the invention be defined by the following claims.

What is claimed is:

1. A liquid supply apparatus, comprising:

a wall that substantially defines a reservoir;

an expandable chamber formed between the wall and a movable piston, wherein the chamber is selectively communicated with the reservoir through an aperture in the wall; and a portal configured to enable fluidic communication of the chamber with a vessel, wherein fluidic communication between the reservoir and the vessel is established through the aperture and the chamber after the piston is moved a predetermined amount, and wherein the aperture is blocked by the piston until the chamber expands beyond a given volume and the piston is moved the predetermined amount.

2. The liquid supply apparatus of claim 1, wherein:

the piston is movable relative to the wall; and the chamber is substantially defined by the piston and the wall.

3. The liquid supply apparatus of claim 1, wherein the chamber is substantially in the form of a cylinder having slidably disposed therein the piston.

4. The liquid supply apparatus of claim 3, wherein the wall substantially defines at least a portion of the cylinder.

5. The liquid supply apparatus of claim 1, and further comprising a substantially elongated probe having an end, wherein:

the probe defines therein a duct;

the probe defines an orifice proximate the end;

the orifice is fluidically communicable with the duct; and the probe is configured to be sealingly inserted through the portal and into the chamber and to impinge upon, and thereby move, the piston to expand the chamber.

6. The liquid supply apparatus of claim 5, wherein the portal comprises a seal configured to sealingly engage the probe.

7. The liquid supply apparatus of claim 5, wherein the piston comprises a feature configured to engage the probe.

8. The liquid supply apparatus of claim 5, wherein the chamber is configured to limit fluid communication of the orifice to only the chamber until the chamber expands beyond the given volume.

9. The liquid supply apparatus of claim 5, wherein the chamber is configured to establish fluidic communication between the reservoir and the orifice only after expansion of the chamber beyond the given volume.

10. The liquid supply apparatus of claim 5, further comprising the vessel, wherein:

the vessel has a volume;

the probe is fluidically communicable with the vessel; and the vessel further comprises a compensator configured to contract the vessel volume in response to expansion of the chamber.

11. A method of establishing fluidic communication between a liquid supply and a vessel, the method comprising:

drawing a given volume of fluid from the vessel into a chamber selectively communicated with the liquid supply through an aperture, including expanding the chamber to draw therein the given volume of fluid from the vessel, and blocking the aperture until the given volume of fluid is drawn from the vessel;

establishing fluidic communication between the liquid supply and the vessel through the aperture and the chamber after drawing the given volume of fluid from the vessel; and contracting at least a portion of the vessel in response to drawing the given volume of fluid.

12. The method of claim 11, further comprising impinging at least a portion of the vessel against at least a portion of the chamber to expand the chamber.

13. The method of claim 11, further comprising inserting at least a portion of the vessel inside the chamber.

14. The method of claim 11, wherein establishing fluidic communication between the liquid supply and the vessel includes blocking the aperture until the given volume of fluid is drawn from the vessel.

15. A method of establishing fluidic communication between a liquid supply and a vessel, the method comprising:

drawing a given volume of fluid from the vessel into a chamber selectively communicated with the liquid supply through an aperture, including expanding the chamber to draw therein the given volume of fluid from the vessel, and blocking the aperture until the given volume of fluid is drawn from the vessel;

establishing fluidic communication between the liquid supply and the vessel through the aperture and the chamber after drawing the given volume of fluid from the vessel;

inserting at least a portion of the vessel inside the chamber; and after inserting the portion of the vessel, impinging the portion of the vessel against at least a portion of the chamber to expand the chamber.

16. The method of claim 15, wherein drawing a given volume of fluid from the vessel includes opening a check valve of the vessel and drawing fluid from a standpipe of the vessel through the check valve.

17. The method of claim 15, wherein establishing fluidic communication between the liquid supply and the vessel includes allowing gas to flow from the chamber and the vessel into the reservoir, and allowing liquid to flow from the reservoir into the chamber and the vessel.

18. The method of claim 15, wherein inserting at least a portion of the vessel inside the chamber includes inserting a probe of the vessel into the chamber, and wherein impinging the portion of the vessel against at least a portion of the chamber includes contacting a piston within the chamber with the probe.

* * * * *